US006546865B2

(12) United States Patent
Fischer et al.

(10) Patent No.: US 6,546,865 B2
(45) Date of Patent: Apr. 15, 2003

(54) DRIVE FOR A DISTRIBUTOR ROLLER IN A PRINTING MACHINE

(75) Inventors: Fred Fischer, Meckesheim (DE); Dieter Schaffrath, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 103 days.

(21) Appl. No.: 09/789,340

(22) Filed: Feb. 20, 2001

(65) Prior Publication Data

US 2001/0052302 A1 Dec. 20, 2001

(30) Foreign Application Priority Data

Feb. 17, 2000 (DE) ..... 100 07 259

(51) Int. Cl.[7] ..... B41F 31/00
(52) U.S. Cl. ..... 101/350.3; 101/DIG. 38
(58) Field of Search ..... 101/147, 148, 101/348, 349.1, DIG. 38, 216, 350.1, 354, 360, 361, 362

(56) References Cited

U.S. PATENT DOCUMENTS

| | | | | |
|---|---|---|---|---|
| 1,322,829 A | | 11/1919 | Schmidt | |
| 1,464,925 A | * | 8/1923 | Dudley | 101/348 |
| 4,295,423 A | * | 10/1981 | Johne et al. | 101/350.3 |
| 4,332,195 A | * | 6/1982 | Mizumura | 101/350.3 |
| 4,620,481 A | * | 11/1986 | Steiner | 101/350.3 |
| 4,944,223 A | * | 7/1990 | Ishii et al. | 101/148 |
| 5,003,874 A | * | 4/1991 | Junghans | 101/348 |
| 5,060,568 A | * | 10/1991 | Jentzsch et al. | 101/148 |
| 5,540,145 A | | 7/1996 | Keller | |

FOREIGN PATENT DOCUMENTS

| | | |
|---|---|---|
| DE | 228216 | 3/1910 |
| DE | 242992 | 4/1911 |
| DE | 1128866 | 5/1962 |
| DE | 1243695 | 9/1968 |
| DE | 3927664 A1 | 3/1991 |
| GB | 2235158 B | 2/1991 |

* cited by examiner

*Primary Examiner*—Ren Yan
(74) *Attorney, Agent, or Firm*—Laurence A. Greenberg; Werner H. Stemer; Ralph E. Locher

(57) ABSTRACT

A drive for a distributor roller in a printing machine includes a drive cam for driving the distributor roller, the drive cam being formed with a cam track and having a rotational axis axially offset eccentrically with respect to a rotational axis of the distributor roller. The drive cam is drivably connected to a motor for rotating the drive cam about the rotational axis of the cam, and an adjusting device is assigned to the drive cam for adjusting an oblique position of the cam track with respect to the rotational axis of the cam.

9 Claims, 4 Drawing Sheets

DRIVE FOR A DISTRIBUTOR ROLLER IN A PRINTING MACHINE

BACKGROUND OF THE INVENTION

Field of the Invention

The invention relates to a drive for a distributor roller in a printing machine.

German Patent 22 82 16 describes such a drive having a cam disk which is not connected to a motor.

German Patent 24 29 92 describes another such drive having a grooved disk which is rotatable about two axes of rotation, one of which is prescribed or predefined by a pin and is provided for oblique positioning of the grooved disk. The other axis of rotation is prescribed or predefined by bearings of a shaft to which the grooved disk is fixed by the pin, and is not arranged eccentrically to an axis of rotation of the distributor roller.

U.S. Pat. No. 5,540,145 describes yet a further such drive, which is shown in FIG. 2 of the U.S. patent, and has a drive cam to which no adjusting device is assigned for adjusting an inclined position of a cam track of the drive cam.

Because of the constructional conditions of the drives described in the aforementioned patents, the drives are subject to functional restrictions or limitations, or the development of the drives for broadening the functions thereof is not possible.

For example, the amplitude of the axial oscillation of the distributor roller described in the U.S. patent is not variably adjustable.

For this reason, the invention is based upon the concept of providing a drive for the distributor roller, which has constructional conditions permitting function-broadening developments of the drive.

SUMMARY OF THE INVENTION

It is accordingly an object of the invention to provide a drive for a distributor roller in a printing machine, which offers the foregoing advantages over heretofore known drives of this general type.

With the foregoing and other objects in view, there is provided, in accordance with one aspect of the invention, a drive for a distributor roller in a printing machine, comprising a drive cam for driving the distributor roller, the drive cam being formed with a cam track and having a rotational axis axially offset eccentrically with respect to a rotational axis of the distributor roller, the drive cam being drivably connected to a motor for rotating the drive cam about the rotational axis of the cam, and an adjusting device assigned to the drive cam for adjusting an oblique position of the cam track with respect to the rotational axis of the cam.

In accordance with another feature of the invention, the drive cam is disposed on a gear element.

In accordance with a further feature of the invention, the adjusting device includes a planar face formed on the gear element and extending obliquely to the rotational axis of the cam.

In accordance with an added feature of the invention, the adjusting device includes a further rotational axis of the cam obliquely inclined to the first-mentioned rotational axis of the cam.

In accordance with an additional feature of the invention, a fixing device is assigned to the drive cam for securing rotational positions of the drive cam, which are adjusted with respect to the gear element.

In accordance with yet another feature of the invention, the fixing device is a clamping device.

In accordance with yet a further feature of the invention, the motor is drivingly connected to the drive cam via an engageable and disengageable coupling device.

In accordance with yet an added feature of the invention, the motor is drivingly connected to the distributor roller for rotating the distributor roller.

In accordance with yet an additional feature of the invention, the drive includes a further motor drivingly connected to the distributor roller for rotating the distributor roller.

In accordance with a concomitant aspect of the invention, there is provided a printing machine having a drive comprising a drive cam for driving the distributor roller, the drive cam being formed with a cam track and having a rotational axis axially offset eccentrically with respect to a rotational axis of the distributor roller, the dive cam being drivably connected to a motor for rotating the drive cam about the rotational axis of the cam, and an adjusting device assigned to the drive cam for adjusting an oblique position of the cam track with respect to the rotational axis of the cam.

The drive according to the invention for driving a distributor roller in a printing machine is distinguished by the fact that an axis of rotation of a drive cam for driving the distributor roller axially is offset eccentrically in relation to an axis of rotation of the distributor roller, by providing the drive cam with drive connections to a motor for rotating the drive cam about the cam axis of rotation, and by assigning to the drive cam an adjusting device for adjusting an oblique position of a cam track of the drive cam with respect to the cam axis of rotation.

One advantage of this drive is that the amplitude of the axial oscillation of the distributor roller can be adjusted or set variably, by adjusting the oblique position of the cam track.

A further advantage of th e drive according to the invention is that the constructional conditions thereof permit various developments, by which additional functions of the drive, going beyond variation of the amplitude, are made possible.

For example, in the drive according to the invention, it is possible for the motor which rotates the drive cam to be linked, via an electronic control device, to a printing unit of the printing machine so that the motor is rendered inactive by the control device at the beginning of an interruption to the printing unit, and is activated again at the end of the printing interruption. During the printing interruption, therefore, the drive cam is not rotated by the motor and, as a result, the axial back-and-forth or reciprocal movement of the distributor roller, which continues to rotate even during the printing interruption, is brought to a standstill. This is advantageous if the distributor roller is a constituent part of an inking unit which inks a printing-plate cylinder belonging to the printing unit and which has an inking-zone adjusting device for adjusting a zonal inking profile. As a result of stopping the axial distributing movement of the distributor roller, the inking profile in the inking unit is prevented from being leveled completely by the distributor roller during the printing interruption. The action of driving the motor by the control device as described, and based upon switching printing-on and switching printing-off in the printing unit, is advantageous if the motor is a separate motor which is included in the printing machine in addition to a main motor which rotates the printing-form or plate cylinder and the distributor roller.

In the case of a printing machine wherein the rotation of the distributor roller and the rotation of the drive cam, and therefore the axial reciprocating or back-and-forth movement of the distributor roller, are driven by one and the same motor, for example, by the main motor which also drives the printing-form cylinder, the arrangement of a coupling device in a drive train which connects the drive cam to the motor can likewise permit the distributor roller to be stopped during the printing interruption. The coupling device, for example, in the form of an engageable clutch or a shift gear mechanism, can be linked with the printing unit via the control device. As a result, the control device can change over the coupling device based upon the switching of the printing unit, so that the drive cam can be uncoupled from the motor when printing is switched off, and coupled to the motor again when printing is switched on. During the printing interruption, the drive cam therefore does not rotate, and the distributor roller rotates without any axial distribution, so that, following the printing interruption, the inking profile needed to continue printing is established rapidly, and rejects are therefore avoided.

Another development which is advantageously made possible by the constructional conditions of the drive according to the invention includes the capability for the cycle rate of the axial oscillation of the distributor roller to be configured so that it can be set variably. By this cycle rate, there is meant the ratio between a number of revolutions of the printing-form cylinder and one complete axial oscillation of the distributor roller. If the motor rotating the drive cam is constructed as the separate motor mentioned hereinbefore, by the control device, the rotational speed thereof and, therefore, the rotational speed of the drive cam can be adjusted in various ratios with respect to the rotational speed of the main motor and, therefore, to the rotational speed of the printing-form cylinder, for example, so that, at one set rotational-speed ratio, the printing-form cylinder rotates once for each complete oscillation of the distributor roller (single-cycle distribution) and, at a different set rotational-speed ratio, rotates twice (half-cycle distribution).

Other features which are considered as characteristic for the invention are set forth in the appended claims.

Although the invention is illustrated and described herein as embodied in a drive for a distributor roller in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
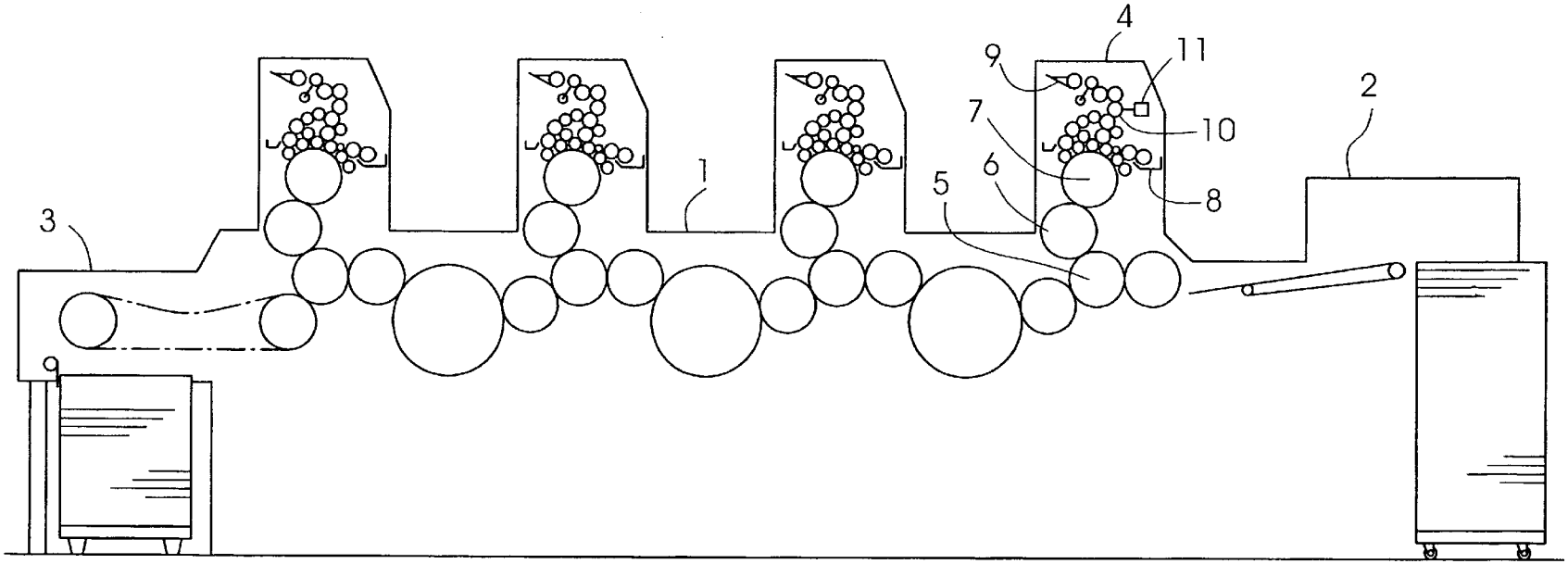
FIG. 1 is a diagrammatic side elevational view of a printing machine having a distributor roller and a drive.

Referring now to the drawings and, first, particularly to FIG. 1, thereof, there is illustrated therein a printing machine 1 with a sheet feeder 2, a sheet delivery 3 and at least one printing unit 4, namely four printing units 4 in the illustrated embodiment. The printing unit 4 includes an impression cylinder 5, a blanket cylinder 6, a printing-form or plate cylinder 7, a dampening unit 8 for dampening and an inking unit 9 for inking the printing-form cylinder 7. The inking unit 9 includes a distributor roller 10 and a cam mechanism 11, illustrated schematically in FIG. 1, for axially oscillating the distributor roller 10 with an oscillation represented in FIG. 2 by a double-headed arrow 12.

Figure 2:
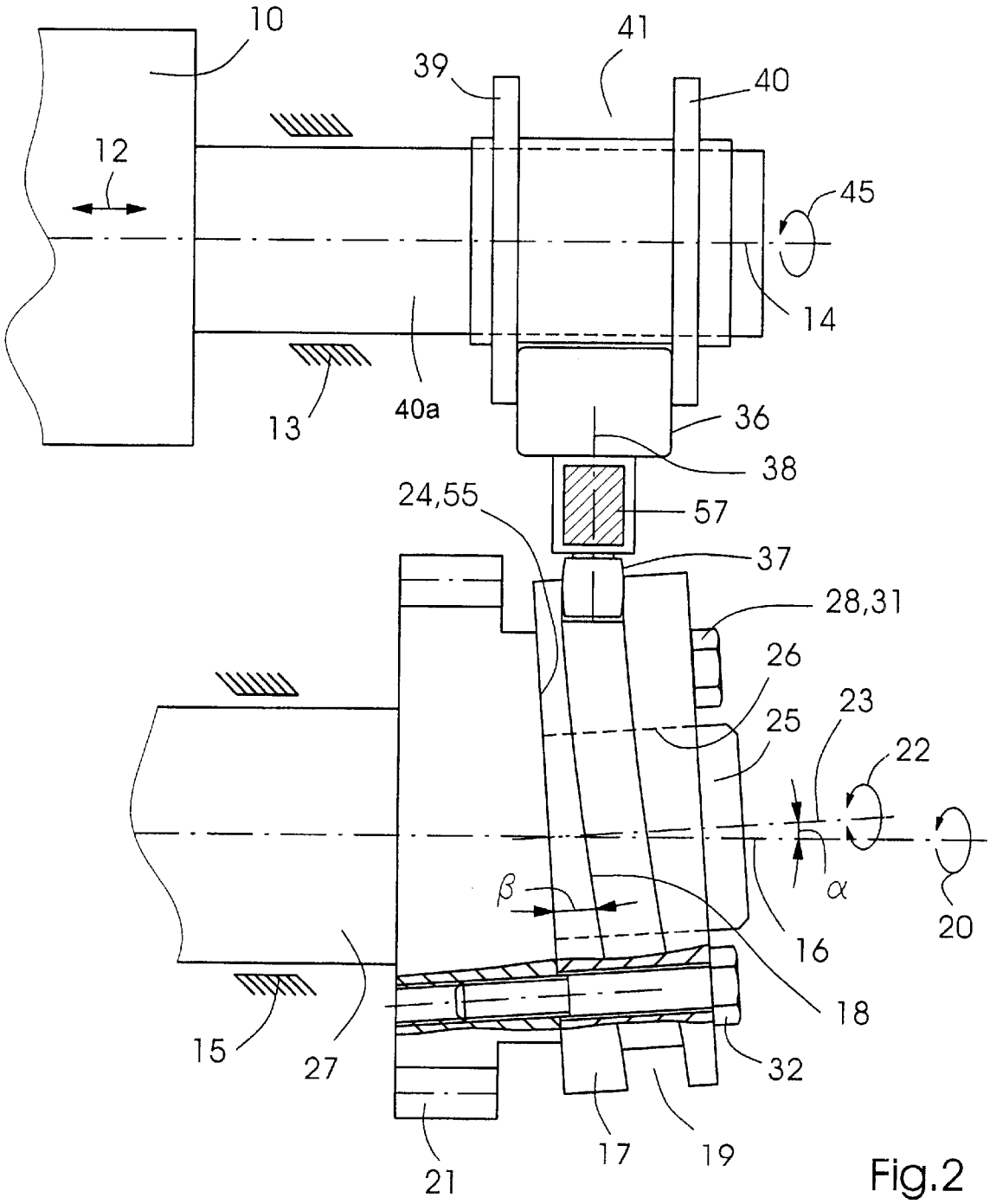
FIG. 2 is an enlarged fragmentary front elevational view, partly in section, of the distributor roller and the drive.

Shown in FIG. 2 is that a rotational axis 14 of the distributor roller 10, prescribed or predefined by a rotary bearing 13, is aligned axially parallel to a first rotational axis 16 of a drive cam 17, which is prescribed or predefined by a rotary bearing 15. The drive cam 17 has a cylindrical shape and is formed with an annular groove 19 which establishes a cam track 18.

The mounting of the drive cam 17 permits both rotation, represented by the arrow 20, of the drive cam 17, together with a gear element 21, about the first rotational axis 16 of the cam 17, and rotation, represented by the arrow 22, of the drive cam 17 relative to the gear element 21 about a second rotational axis 23 of the cam 17 set obliquely at an angle $\alpha$ relative to the first rotational axis 16 of the cam 17. The gear element 21, which is a drive gear with end-face toothing, has an annular planar face 24 which extends perpendicularly to the second rotational axis 23 of the cam 17. A cylindrical bearing journal 25 integrally molded on the gear element 21 is inserted into a central bore formed in the drive cam 17 and, together with the bore, forms a rotary bearing 26 which permits the rotation represented by the arrow 22 and establishes the oblique alignment of the second rotational axis 23 of the cam 17. The gear element 21 is pushed onto a shaft 27 and connected thereto so as to be fixed against rotation relative thereto.

The planar face 24 and the second rotational axis 23 of the cam 17 form an adjusting device 55 for adjusting the angle of the cam track 18 relative to the first rotational axis 16 of the cam 17.

A fixing device 28 may be loosened in order to rotate the drive cam 17 about the rotary bearing 26 into various rotary positions relative to the gear element 21, and permits the drive cam 17 to be connected so as to be fixed against rotation relative to the gear element 21 in each of the continuously selectable rotary positions. The fixing device 28 is constructed as a bolted or screwed joint and includes arcuate slots 29 and 30, shown in FIG. 3, which are formed in the drive cam 17 and are coaxial with the second rotational axis 23 of the cam 17, screws 31 and 32 are inserted into and extend through the respective arcuate slots 29 and 30, and are screwed into the gear element 21. When the screws 31 and 32 are tightened, the screw heads thereof press against the drive cam 17 which is thereby firmly clamped in the desired rotary position on the gear element 21. Instead of the manually adjustable adjusting device 55, a remotely operatable adjusting device can also be provided.

The hereinaforementioned angle $\alpha$ is exactly the same size as an angle $\beta$ between the planar face 24 and the cam track 18. A critical factor is that high and low points of the drive cam 17 and of the gear element 21 can be caused to coincide or overlap so that those points selectively add (amplitude enlargement) or cancel out (amplitude reduction).

After an assumed 180° rotation 22 of the drive cam 17 from the 0° position thereof shown in FIG. 2, the cam track 18 and the planar face 24 would therefore extend parallel to one another. Consequently, the drive cam 17 would rotate about the first rotational axis 16 of the cam 17 without causing the distributor roller 10 to oscillate, i.e., the amplitude of the axial oscillation of the distributor roller 10 would have a zero value. If the angle β were selected so that it did not correspond exactly to the angle α, the distributor roller 10, in the non-illustrated 180° position of the drive cam 17, would then oscillate with a minimum amplitude which is greater than zero.

Figure 3:
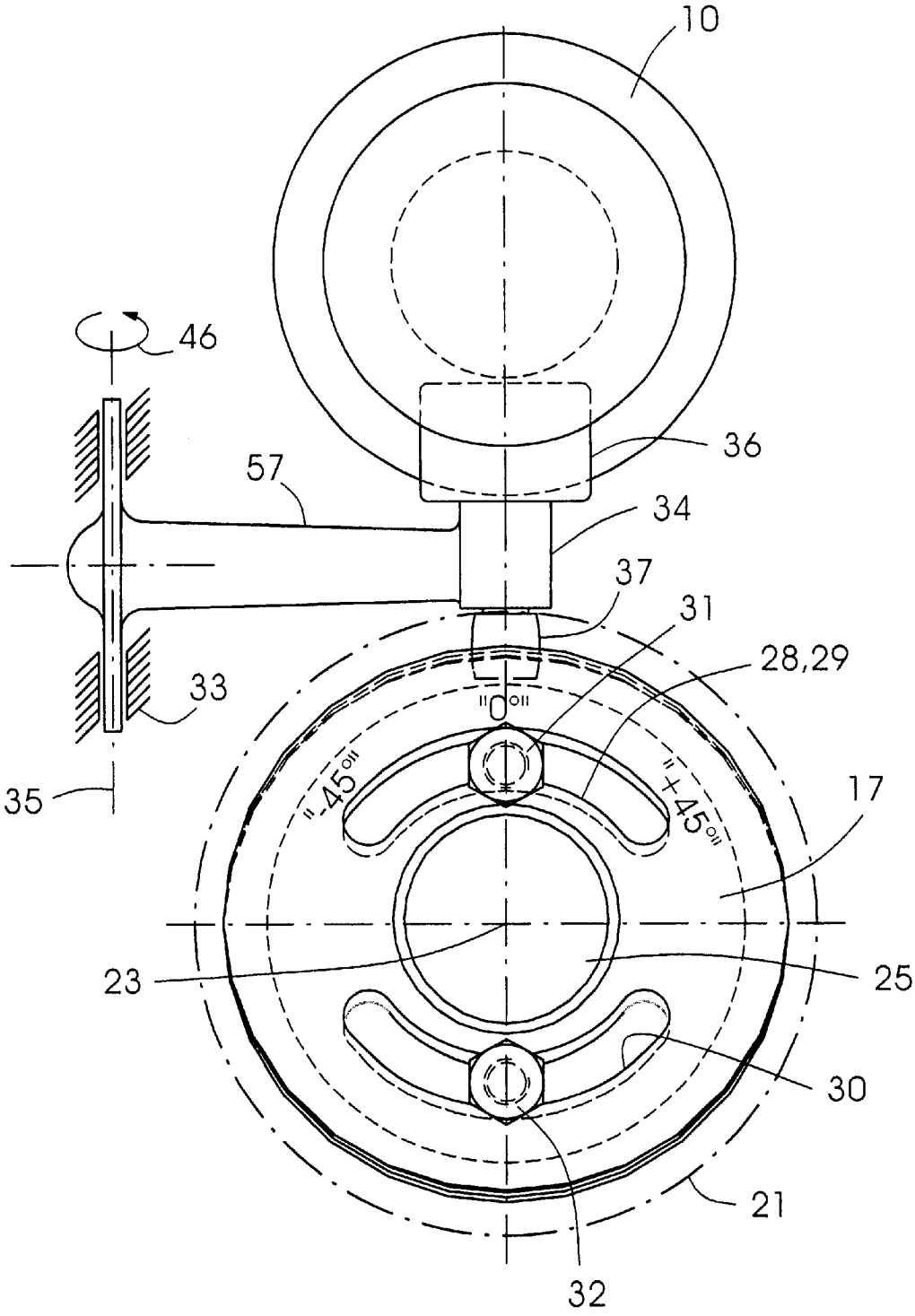
FIG. 3 is a side elevational view of the distributor roller and the drive shown in FIG. 2.

Although the fixing device 28 shown in FIGS. 2 and 3 permits only rotations of the drive cam 17 in the order of magnitude of about +45° in one direction and about −45° in the other direction, due to the rather limited length here of the slots 29 and 30, the fixing device 28 may, however, be modified in a relatively simple manner so that the assumed 180° rotation is possible. For example, it would be necessary only to omit the slot 30 and the screw 32 and to extend the remaining slot 29 beyond an angular range of 180°.

When the rotating drive cam 17 is set in the 0° position thereof shown in FIG. 2, the likewise rotating distributor roller 10 is pushed back and forth with a maximum amplitude by the drive cam 17 via an entrainer or driver 34, which is mounted so that it can move in a rotary bearing 33 fixed to the frame. The rotary bearing 33 establishes the perpendicular alignment to the rotational axes 14 and 16, of a rotational axis 35, about which the entrainer 34 is pivotable. The entrainer 34 is formed as a rocking lever with a cylindrical roller 36 and a convex roller 37. The rollers 36 and 37 are arranged on one and the same lever arm 57 of the entrainer 34 so that they are coaxial with one another and can rotate about a rotational axis 38 that is axially parallel to the rotational axis 35.

Two annular webs or crosspieces 39 and 40 on an axle journal 40*a* of the distributor roller 10 enclose or define therebetween an annular groove 41. The roller 36 runs in the groove 41, and the roller 37 rolls along the cam track 18 in the groove 19 when the drive cam 17 is rotated by an electric motor 42 (note FIG. 4) or by an electric motor 43 (note FIG. 5), and the distributor roller 10 is rotated, as represented by the arrow 45, by an electric motor 44 (note FIG. 4) or the electric motor 43 (note FIG. 5). In each case of the reciprocatory pivoting movement 46 of the entrainer 34 about the rotational axis 38, the movement being effected via the drive cam 17, the secure and reliable engagement of the entrainer 34 in the grooves 19 and 41 is assured by the rollers 36 and 37.

Depending upon whether the drive cam 17 is firmly held on the gear element 21 by the fixing device 28 in the 0° position, the +45° position (or the −45° position) or any other selective position lying between 0° and 45°, the drive cam 17 forces an oscillation with a maximum, moderate or minimum, and thus continuously adjustable oscillation amplitude, on the distributor roller 10.

Figure 4:
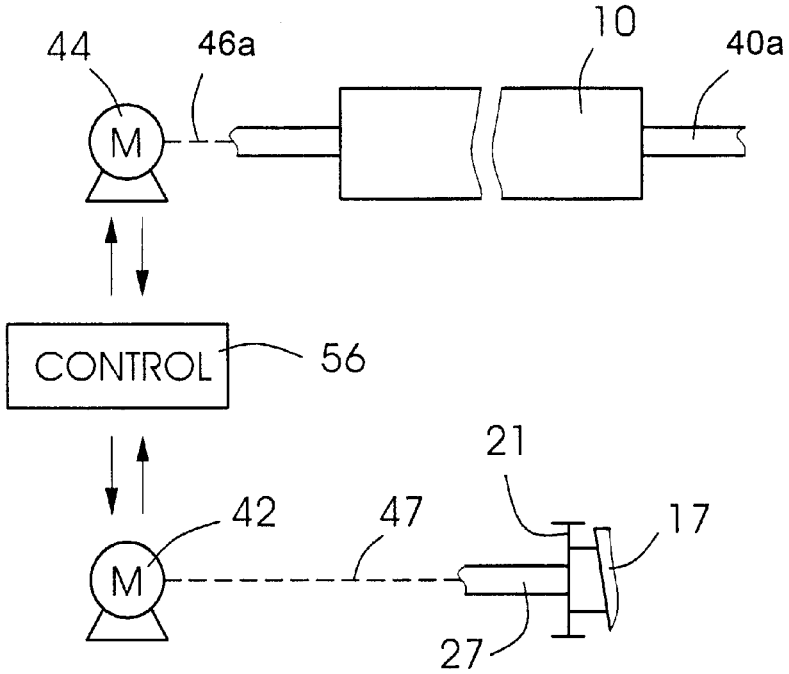
FIG. 4 is a schematic and diagrammatic view of a first embodiment of the distributor roller-drive shown in FIGS. 1 to 3.

FIG. 4 shows a first embodiment of the drive described hereinbefore in connection with FIGS. 1 to 3. In this first embodiment, the motor 44 is a main motor belonging to the printing-machine 1, which is drivingly connected to the cylinders 5 and 7 for rotatively driving them and which, during the printing operation, rotatively drives the distributor roller 10 (rotation represented by the arrow 20) via a highly schematically and diagrammatically presented drive train 46*a* formed of gears. The motor 44 has a control link to a motor 42, used as a separate motor, via an electronic control device 56. During a printing operation, the motor 42 rotates the drive cam 17 via a drive train 47 which includes the drive gear 21 and a gear meshing therewith but otherwise not specifically illustrated.

By the control device 56, the speed of the motor 42 can be controlled both independently of the motor 44 and dependent upon the motor 44. For example, during a printing interruption with the motor 44 continuing to run, the motor 42 is able to be stopped (independent control) and, during a printing operation, in the event of changes to the printing speed and changes to the rotational speed of the motor 44, the motor 42 can also be carried along with the motor 44 in accordance with the changes (dependent control).

By selecting specific rotational speed relationships between the speed of the motor 42 and the speed of the motor 44, the cycle rate of the distributor roller 10 can be adjusted in this manner.

Figure 5:
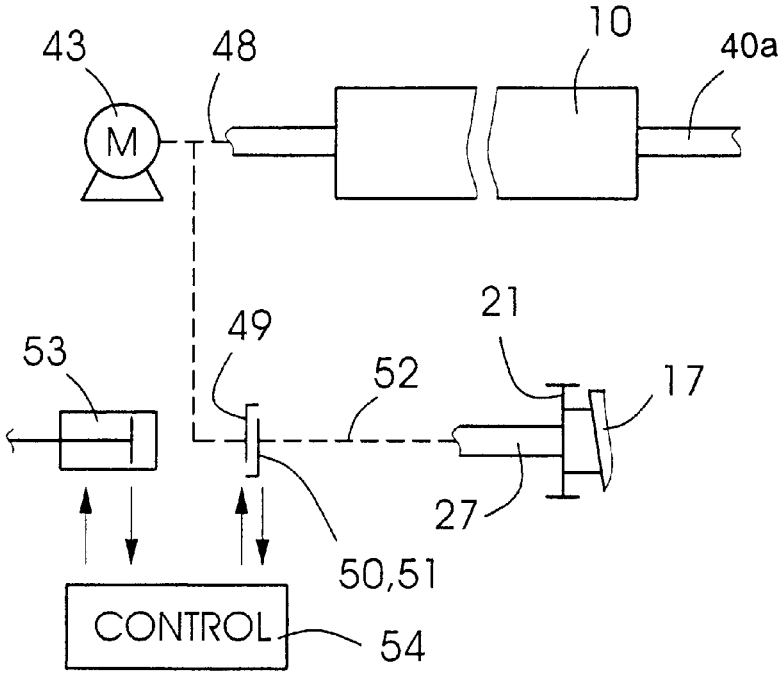
FIG. 5 is a view like that of FIG. 4 of a second embodiment of the distributor roller-drive shown in FIGS. 1 to 3.

FIG. 5 shows a second embodiment of the drive described hereinbefore in connection with FIGS. 1 to 3. In functional and constructional terms, the motor 43 corresponds to the motor 44, and the drive train 48 corresponds to the drive train 46 constructed, for example, as a gear mechanism or transmission, so that in this regard no further explanations relating to the motor 43 are believed to be necessary.

A coupling device 51 formed as a switching coupling with two coupling halves 49 and 50 is a constituent part of a drive train 52, to which the drive gear 21 and a gear mutually engaged with the latter also belong, and via which the motor 43 rotatively drives the drive cam 17 (rotation represented by the arrow 20). The coupling device 51 is changeable or shiftable over, for example, by an electronic control device 54 also driving an actuating drive 53, into a disengaging position wherein the coupling halves 49 and 50 are separated from one another, and a coupling position wherein the coupling halves 49 and 50 are in a frictional or formlocking connection with one another. In this regard, it is noted that a formlocking connection is one which connects two elements together due to the shape of the elements themselves, as opposed to a forcelocking connection, which locks the elements together by force external to the elements.

In the disengaged position, the drive train 52 is interrupted, so that the motor 43 rotates the distributor roller 10 but not the drive cam 21, and therefore does not cause the distributor roller 10 to oscillate via the latter.

In the engaged position, and therefore with the drive train 52 closed, the drive motor 43 drives the distributor roller 10 both rotatively, as well as axially.

The actuating drive 53 has a drive connection to the blanket cylinder 6 in order to displace the blanket cylinder 6 towards the impression cylinder 5 (print-on switching) and away from the impression cylinder 5 (print-off switching), and is formed as a working cylinder to which compressed air can be applied.

We claim:

1. A drive for a distributor roller in a printing machine, comprising a drive cam for driving the distributor roller, said drive cam being formed with a cam track and having a first rotational axis offset eccentrically with respect to a rotational axis of the distributor roller, said drive cam being drivably connected to a motor for rotating the drive cam about said first rotational axis of said cam, and an adjusting device assigned to said drive cam for adjusting an oblique position of said cam track with respect to said first rotational axis of said cam, said adjusting device including a second rotational axis of said cam obliquely inclined to said first rotational axis of said cam.

2. The drive according to claim 1, wherein said drive cam is disposed on a gear element.

3. The drive according to claim 2, wherein said adjusting device includes a planar face formed on said gear element and extending obliquely to said first rotational axis of said cam.

4. The drive according to claim 2, wherein a fixing device is assigned to said the drive cam for securing rotational positions of said drive cam, which are adjusted with respect to said gear element.

5. The drive according to claim 4, wherein said fixing device is a clamping device.

6. The drive according to claim 1, wherein said motor is drivingly connected to said drive cam via an engageable and disengageable coupling device.

7. The drive according to claim 1, wherein said motor is drivingly connected to the distributor roller for rotating the distributor roller.

8. The drive according to claim 1, including a further motor drivingly connected to the distributor roller for rotating the distributor roller.

9. A printing machine having a distributor roller and a drive, said drive comprising a drive cam for driving the distributor roller, said drive cam being formed with a cam track and having a first rotational axis offset eccentrically with respect to a rotational axis of the distributor roller, said drive cam being drivably connected to a motor for rotating the drive cam about said first rotational axis of said cam, and an adjusting device assigned to said drive cam for adjusting an oblique position of said cam track with respect to said first rotational axis of said cam, said adjusting device including a second rotational axis of said cam obliquely inclined to said first rotational axis of said cam.

* * * * *